United States Patent [19]

Shields et al.

[11] 4,282,725

[45] Aug. 11, 1981

[54] CIRCULAR KNITTING MACHINE WITH LATCH DETECTOR

[75] Inventors: Harper Shields, Burlington; Roscoe M. Farrell, Pittsboro, both of N.C.

[73] Assignee: Kayser-Roth Hosiery, Inc., Burlington, N.C.

[21] Appl. No.: 143,793

[22] Filed: Apr. 25, 1980

[51] Int. Cl.[3] ..... D04B 35/10

[52] U.S. Cl. ..... 66/157; 66/111

[58] Field of Search ..... 66/165, 157, 163, 111

[56] References Cited

U.S. PATENT DOCUMENTS

| | | | |
|---|---|---|---|
| 2,161,209 | 6/1939 | Vossen | 66/157 |
| 2,257,037 | 9/1941 | Crawford | 66/157 |
| 2,755,648 | 7/1956 | Vossen | 66/157 |
| 2,888,813 | 6/1959 | Deans et al. | 66/157 |
| 2,963,890 | 12/1960 | Hoots | 66/157 |
| 3,004,417 | 10/1961 | Lunak | 66/157 |
| 3,397,556 | 8/1968 | Wood | 66/157 X |
| 3,834,190 | 9/1974 | Kuhn | 66/157 |

FOREIGN PATENT DOCUMENTS

| | | | |
|---|---|---|---|
| 1470542 | 1/1967 | France | 66/157 |
| 1289106 | 9/1972 | United Kingdom | 66/157 |

*Primary Examiner*—Ronald Feldbaum

*Attorney, Agent, or Firm*—Bell, Seltzer, Park & Gibson

[57] ABSTRACT

The knitting machine is provided with latch detector means for detecting a latch improperly positioned in a closed position and for signaling when such a condition occurs. A trigger lever (30) having a free inner end (31) is normally positioned in an operative latch detecting position (FIG. 3) immediately below the path of travel of the hooked upper ends (10) of the needles N so that a latch (11) in the proper open position will not engage and trip the trigger lever (30) while a latch (11) in an improper closed position will engage and trip the trigger lever (30). A tension spring (45) is provided to immediately move the trigger lever (30) to the inoperative position (FIG. 4) with the inner free end (31) outwardly and away from the path of travel of the needles N upon being engaged by a latch in an improper closed position.

5 Claims, 4 Drawing Figures

CIRCULAR KNITTING MACHINE WITH LATCH DETECTOR

FIELD OF THE INVENTION

This invention relates generally to detecting improperly positioned latches of the needles on a circular knitting machine and more particularly to such a machine having a latch detector for the detection of needle latches in improperly positioned closed position and for signaling such condition.

BACKGROUND OF THE INVENTION

It is generally known to provide needle latch detectors on circular knitting machines for indicating the improper positioning of the latches, which condition usually occurs when a stitch loop is not present on the needle to move the latch to an open position. However, the prior known types of latch detectors have not been widely used because they are expensive and/or difficult to maintain in the proper operative position because vibration from the knitting machine will frequently trip the latch detector. Also, if the sensitivity of the latch detector is set to prevent false detection, there is a possibility of damage to the needle latch when it engages the latch detector.

SUMMARY OF THE INVENTION

With the foregoing in mind, it is an object of the present invention to provide a circular knitting machine with a latch detector which is inexpensive, is not subject to false indication of closed latches from vibration of the knitting machine, and does not cause damage to the needle latches during operation.

In accordance with the present invention, the knitting machine is provided with a latch detector comprising a trigger lever having a free end normally positioned in an operative latch detecting position immediately below the path of travel of the upper hooked ends of the needles so that latches in the proper open position do not engage the free end of the trigger lever while latches in an improper closed position will engage and initially move the free end of the trigger lever in the direction of movement and away from the path of travel of the needles. The trigger lever is pivotally mounted intermediate its ends and is normally positioned against a stop member with resilient means being provided to normally urge the trigger lever into engagement with the stop means. The resilient means is operable to immediately move the free end of the trigger lever to an inoperative position outwardly of and away from the path of travel of the needles upon engagement by a latch in an improper closed position. Sensor means is also provided and is operable by the trigger lever for signaling when the free end of the trigger lever is engaged by an improperly closed latch and moved away from the path of travel of the needles.

BRIEF DESCRIPTION OF THE DRAWINGS

Other objects and advantages will appear as the description proceeds when taken in connection with the accompanying drawings, in which.

DESCRIPTION OF THE ILLUSTRATED EMBODIMENT

Figure 1:
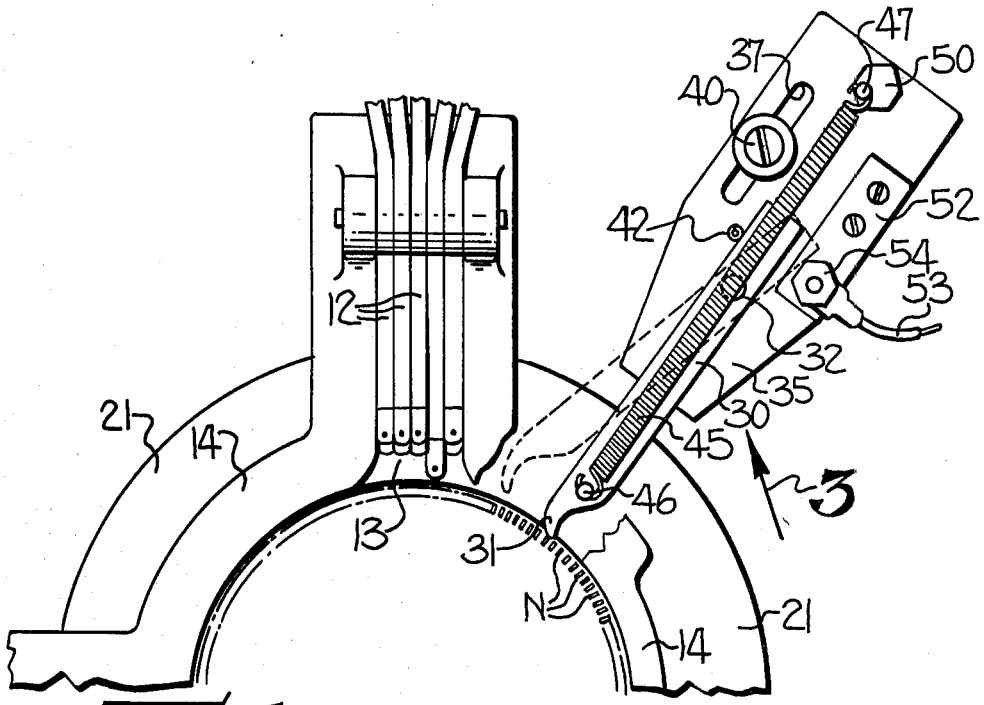
FIG. 1 is a fragmentary plan view of a portion of the latch ring and sinker head of a circular knitting machine and showing the latch detector associated therewith.
Figure 2:
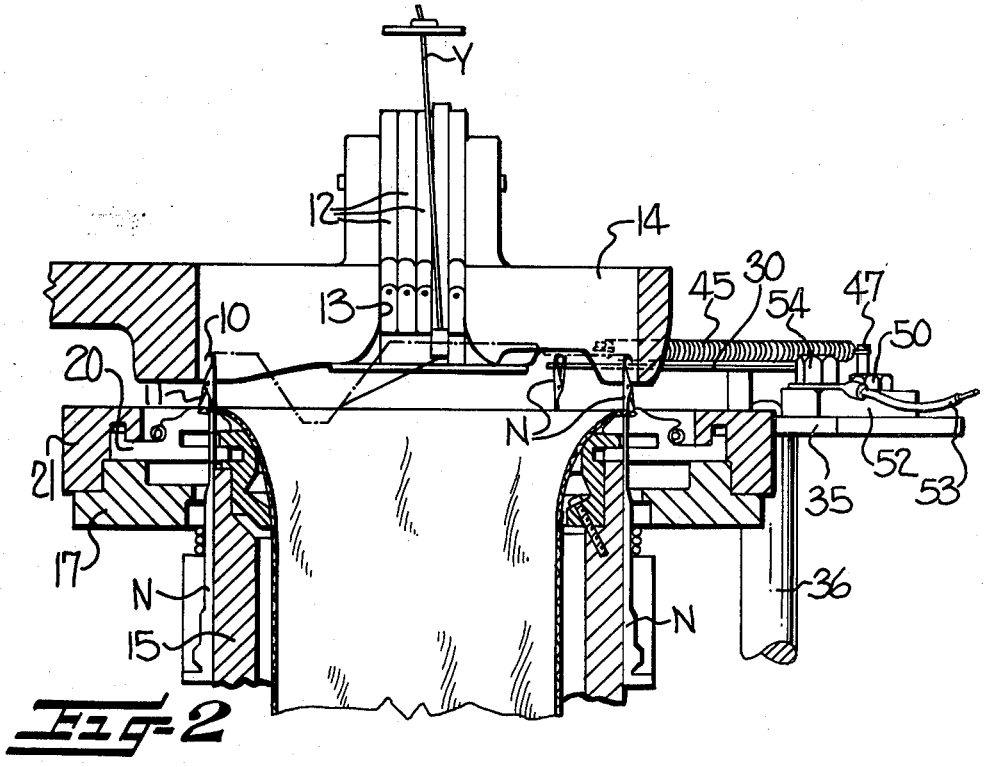
FIG. 2 is a vertical sectional view of the upper end portion of the latch ring, sinker head and upper end of the needle cylinder and showing the latch detector associated therewith.

The circular knitting machine is illustrated as being of the type normally employed in knitting socks and the like and includes a single knitting station. However, it is to be understood that the latch detector means may be employed on other types of knitting machines having either a single or multiple knitting stations and a latch detector can be positioned adjacent each or selected knitting stations. The knitting machine includes a rotating circle of needles N and each of the needles includes an upper hooked end 10 with a pivoted latch 11 movable between open and closed positions. As illustrated in FIGS. 1 and 2, yarn feed fingers 12 are supported for movement into and out of yarn feeding position in a throat opening 13 in a latch ring 14. The yarn feed fingers 12 operate to selectively feed yarns, such as indicated at Y in FIG. 2, to the needles as they are raised and lowered, as indicated by the dash-dot line in FIG. 2, with rotation of the needle cylinder 15. The needles are raised and lowered by conventional cams, not shown, in the conventional and well-known manner.

A sinker bed 17 is supported on the upper end of the needle cylinder 15 and supports sinkers 20 for radial sliding movement between the needles N and the movement of the sinkers 20 is controlled by conventional cams in a sinker cap 21. As the needles N approach the yarn feed fingers Y, they are maintained in a position with the prior knit loops holding the latches 11 in a fully open position. Just prior to the point that the yarn Y is fed to the needles, the needles are further raised to a "shed" level where the prior stitch loops pass below the level of the lower tips of the latches 11 so that the latch remains open but is free to pivot to the closed position. As the yarn Y is fed into the upper hooked ends 10 of the needles, and they are lowered by the stitch cam in the conventional manner, as indicated in dash-dot lines in FIG. 2, the latches move to a closed position and the needles are drawn down to stitch drawing level below the throats of the sinkers 20 so that the prior stitch loops are shed or cast off and a new knit loop is formed by the yarn Y. The needles are then raised so that the just formed stitch loop is drawn down the shank of the needle and pivots the latch 11 back to the open position.

The latch detector means includes a trigger lever 30 including a free inner, somewhat hooked end 31. Support means is provided for supporting the trigger lever 30 for pivotal movement intermediate its ends, as indicated at 32, and the inner free end 31 of the trigger lever 30 is normally positioned in the operative latch detecting position shown in solid lines in FIG. 1 and illustrated in FIG. 3. In this operative latch detecting position, the inner free end 31 of the trigger lever 30 is positioned immediately below the path of travel of the upper hooked ends 10 of the needles N so that a latch 11 in the proper open position does not engage the free end 31 of the trigger lever 30.

The support means includes a horizontal support plate 35 which is supported for adjustment adjacent the sinker cap 21 and on the upper end of a support post 36

(FIG. 2), the lower end of which is fixed on the knitting machine. An adjustment slot 37 is provided in the plate 35 (FIG. 1) and a screw 40 penetrates the slot 37 and is threadably embedded in the upper end of the post 36.

Stop means, in the form of a vertical pin 42, is fixed on its lower end in the support plate 35 and extends upwardly adjacent one side of the trigger lever 30 to limit pivotal movement of the trigger lever 30 in a counterclockwise direction. The pin 42 also determines the position of the trigger lever 30 when in an operative latch detecting position, as shown in solid lines in FIG. 1 and in FIG. 3.

Resilient means, in the form of a tension spring 45, is operable to normally urge the trigger lever 30 into engagement with the stop pin 42 and maintain the trigger lever 30 in the operative latch detecting position. The tension spring 45 is supported at its inner end in a spring perch pin 46 which is fixed in the inner end portion of the trigger lever 30 and the outer end of the tension spring 45 is supported on a spring perch pin 47, the lower end of which is supported in eccentric position on the head of an adjustment bolt 50. The adjustment bolt 50 extends through the support plate 35 and is provided with a lock nut, not shown, for maintaining the adjusted position of the head of the adjustment bolt 50, for purposes to be presently described.

Figure 3:
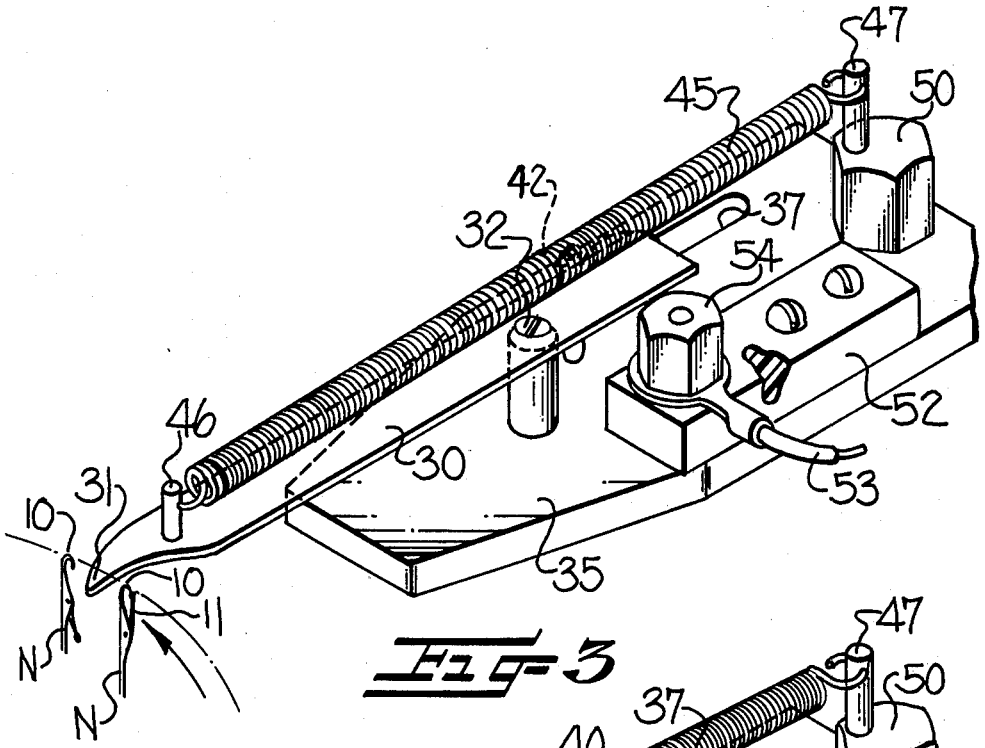
FIG. 3 is an isometric view of the latch detector and indicating the path of travel of the latch needles adjacent the outer free end of the trigger lever.
Figure 4:
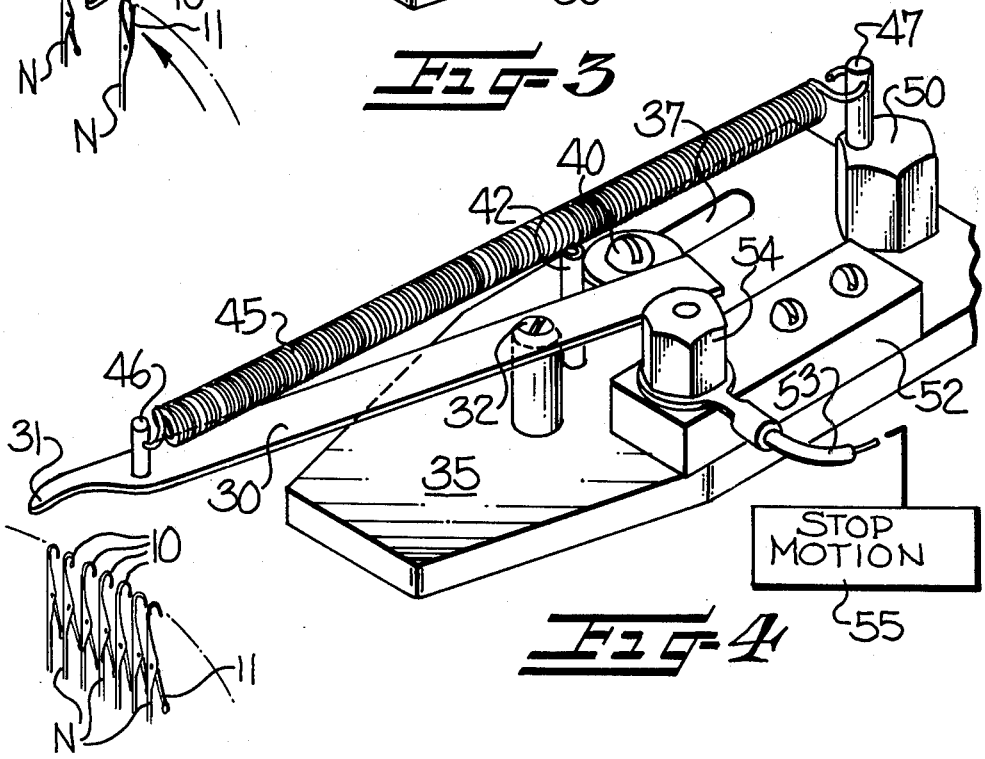
FIG. 4 is a view similar to FIG. 3 but illustrating the trigger lever in "tripped" position.

The tension spring 45 is also operable to immediately move the free end 31 of the trigger lever 30 to an inoperative position outwardly and away from the path of travel of the needles N upon being engaged by a latch 11 in an improper closed position. As indicated in FIG. 3, the right-hand needle N is approaching the free inner end 31 of the trigger lever 30 in an improper closed position and will engage the free end 31 of the trigger lever 30 to immediately "trip" the lever 30. Upon the lever 30 being moved slightly in a clockwise direction, and away from the stop pin 42, the tension spring 45 immediately and quickly moves the lever from the position shown in FIG. 3 to the position shown in FIG. 4 so that the free end of the lever 30 will be moved outwardly and away from the path of travel of the needles to avoid damage to any of the latches. Also, the adjustment bolt 50 can be rotated to change the position of the outer spring perch pin 47, relative to the pivot point 32, so that the "sensitivity" of the tripping of the trigger lever 30 can be varied to prevent false movement due to vibration of the knitting machine and to vary the amount of impact necessary by the latch 11 to trip the trigger lever 30 so as to insure that the latch is not damaged by the trigger lever.

Sensor means is provided to be operated by the trigger lever 30 for signaling when the free end 31 of the trigger lever 30 is engaged by an improper closed latch 11 and moved outwardly and away from the path of travel of the needles N. The sensor means includes an electrical insulation block 52 supported on the upper surface of the support plate 35 and an electrical wire 53 fixed on the block 52 by a nut 54 which also serves as a stop and electrical ground contact against which the trigger lever is pulled by the spring 45, as illustrated in dotted lines in FIG. 1 and in FIG. 4. The wire 53 is connected to a conventional stop motion, indicated in block form at 55 in FIG. 4. The wire 53 forms a portion of a detector or sensor circuit which is actuated when the lever 30 engages the nut 54 and may operate to turn on a signal light for the operator and/or stop the operation of the knitting machine through the conventional stop motion provided on the knitting machine.

The latch detector means thus provides for detecting a latch improperly positioned in a closed position when it should be in an open position and for signaling when such a condition occurs in the knitting machine. The latch detector means is of simple construction, virtually trouble free in operation and may be operated over a long period of time without damage to the latches of the needles. The sensitivity of the latch detecting means may be varied in accordance with the type of machine to which it is applied.

In the drawings and specification there has been set forth the best mode presently contemplated for the practice of the invention, and although specific terms are employed, they are used in a generic and descriptive sense only and not for purposes of limitation, the scope of the invention being defined in the claims.

That which is claimed is:

1. In a circular knitting machine including a circle of needles mounted for rotation about a fixed axis, each of said needles including an upper hooked end and a pivoted latch movable between open and closed positions, and yarn feed fingers for feeding yarn to said needles as said needles are raised and lowered to form stitch loops, the combination therewith of latch detector means for detecting a latch improperly positioned in a closed position, said latch detector means comprising (a) a trigger lever including a free end, (b) means supporting said trigger lever for pivotal movement intermediate its ends and about an axis parallel to said fixed axis of said circle of needles, said free end being normally positioned in an operative latch detecting position immediately below the path of travel of said upper hooked ends of said needles so that a latch in the proper open position does not engage said free end of said trigger lever and while a latch in an improper closed position will engage and initially move said free end of said trigger lever to an inoperative position wherein said free end is moved in the direction of movement and outwardly away from the path of travel of said needles, (c) stop means mounted on said supporting means and adapted to engage one side of said trigger lever for normally maintaining said free end of said trigger lever in said detecting position, (d) resilient means mounted between said trigger lever and said supporting means for urging said trigger lever into engagement with said stop means with said trigger lever in said detecting position, and for immediately moving said free end of said trigger lever to said inoperative position outwardly and away from the path of travel of said needles upon being laterally deflected from said detecting position by a latch in an improper closed position, and (e) sensor means operable by said trigger lever for signaling when said free end of said trigger lever is engaged by a closed latch and moved outwardly and away from the path of travel of said needles.

2. In a circular knitting machine according to claim 1 wherein said means supporting said trigger lever for pivotal movement includes a horizontal support plate pivotally supporting said trigger lever for limited pivotal movement in spaced relationship thereabove, and wherein said stop means comprises a stop pin fixed at its lower end in said support plate and extending upwardly therefrom and adjacent one side of said trigger lever for engagement therewith when said trigger lever is positioned in said operative detecting position.

3. In a circular knitting machine according to claim 2 wherein said resilient means comprises a tension spring fixed at one end on said trigger lever and adjacent the free inner end thereof, and the opposite end of said tension spring being supported on said support plate and adjacent the outer end of said trigger lever.

4. In a circular knitting machine according to claim 3 including adjustment means for varying the position of the outer end of said tension spring to thereby vary the sensitivity of the tripping of said trigger lever.

5. In a circular knitting machine according to claim 4 wherein said sensor means includes a stop member against which said trigger lever is engaged when said inner end of said trigger lever is moved to an inoperative position outwardly and away from the path of travel of said needles, and electric wire means connected to said stop member and forming part of an electrical circuit operable to signal the detection of a latch in improperly positioned closed position.

* * * * *